United States Patent [19]

Chang

[11] Patent Number: 4,633,066

[45] Date of Patent: Dec. 30, 1986

[54] THERMOSTATICALLY CONTROLLED DUAL MODE ELECTRIC WATER HEATING RECEPTACLE

[76] Inventor: Tien-Song Chang, 2, Ground Floor, Lane 221, Jin Ping Rd., Chung Ho City, Taipei Hsien, Taiwan

[21] Appl. No.: 668,326

[22] Filed: Nov. 5, 1984

[51] Int. Cl.[4] ..... H05B 1/02; H05B 3/60

[52] U.S. Cl. ..... 219/437; 99/281; 219/272; 219/275; 219/284; 219/288; 219/295; 219/331; 219/506; 338/80

[58] Field of Search ..... 219/284–295, 219/271–276, 436–438, 506, 331, 441, 442; 338/80–86; 122/4 A, 13 A; 99/281

[56] References Cited

U.S. PATENT DOCUMENTS

| | | | |
|---|---|---|---|
| 1,355,644 | 10/1920 | Beaudet | 219/291 |
| 1,525,508 | 2/1925 | McCormick | 219/292 |
| 1,944,348 | 1/1934 | Kelley | 219/295 X |
| 1,985,623 | 12/1934 | Ross | 219/288 X |
| 2,725,458 | 11/1955 | Bremer | 219/295 X |
| 3,020,385 | 2/1962 | Conlin e al. | 219/295 X |

FOREIGN PATENT DOCUMENTS

| | | | |
|---|---|---|---|
| 547940 | 6/1956 | Belgium | 219/293 |
| 2657786 | 6/1978 | Fed. Rep. of Germany | 219/289 |
| 412253 | 11/1945 | Italy | 219/293 |
| 816905 | 7/1959 | United Kingdom | 219/436 |

*Primary Examiner*—Anthony Bartis
*Attorney, Agent, or Firm*—Leonard Bloom

[57] ABSTRACT

An electric water heating receptacle is provided with an anode member and a cathode member arranged in spaced juxtaposed relationship and connected to an electric power source such that water in the receptacle is heated by current flowing through the water from the anode member to the cathode member. The anode member has separate major and minor portions which are initially both connected to the power source in a "high mode" of operation to rapidly heat the water in the receptacle to a predetermined temperature. Upon attainment of the predetermined temperature, a thermostat responsive to the water temperature disconnects the major portion of the anode leaving only the minor portion energized in a "low mode" of operation intended to maintain the water substantially at the predetermined temperature. Should the water temperature drop below the predetermined temperature, the thermostat reconnects the major anode portion for operation in the "high mode" to reestablish the predetermined water temperature. Indicators are provided to show that the heating receptacle is operative, that water must be added to the receptacle and that sufficient water is in the receptacle.

14 Claims, 4 Drawing Figures

THERMOSTATICALLY CONTROLLED DUAL MODE ELECTRIC WATER HEATING RECEPTACLE

FIELD OF THE INVENTION

The present invention relates to fluid heaters, and more particularly, to electric water heaters in which the water being heated is the conductive element between respective anode and cathode members.

BACKGROUND OF THE INVENTION

Conventional electric water heaters operate by passing current through a submerged metal coil. The metal coil acts as a resistor giving up heat to the surrounding water. Should the water level in the receptacle reach an unacceptably low level, the build-up of heat in the metal coil may cause damage or create a hazard, hence is undersirable.

While the conventional coil heater has gained widespread acceptance, there exists a need for an electric heating element and associated circuitry which is economical to produce, efficient in operation, and relatively safe. This need occurs in both the original equipment market as well as the replacement market, and in both residential and industrial applications.

SUMMARY OF THE INVENTION

Accordingly, it is an object of the present invention to provide a relatively safe and efficient electric water heater which is economical to produce.

It is a further object of the present invention to provide a water heating device and associated circuitry which is adaptable to residential or industrial use.

It is yet another object of the present invention to provide an electric water heating device and associated circuitry which will be suitable for the original equipment market as well as the aftermarket replacement of damaged conventional heating elements.

In accordance with the teachings of the present invention, a preferred embodiment of the electric water heater is disclosed, wherein the device is adapted to be received within a suitable receptacle of water. The device includes an anode member and further includes a cathode member in juxtaposition to the anode member. Means are provided for connecting the anode and cathode members to a suitable source of electrical current. The anode member or the cathode member (or both) may have means formed therein for the passage of water therethrough. With this arrangement, the current flowing through the water from the anode member to the cathode member heats the water. Preferably, the anode member has first and second portions, and a thermally-responsive switch means is provided for disconnecting one of the portions of the anode member, thereby providing both high and low heat positions. A first indicating means signals that the device has been energized. A second indicating means signals that water must be added to the receptacle. A third indicating means signals that sufficient water is in the receptacle.

These and other objects of the present invention will become apparent from a reading of the following specification, taken in conjunction with the enclosed drawings.

GENERAL DESCRIPTION OF THE PREFERRED EMBODIMENT

Figures 1, 2:
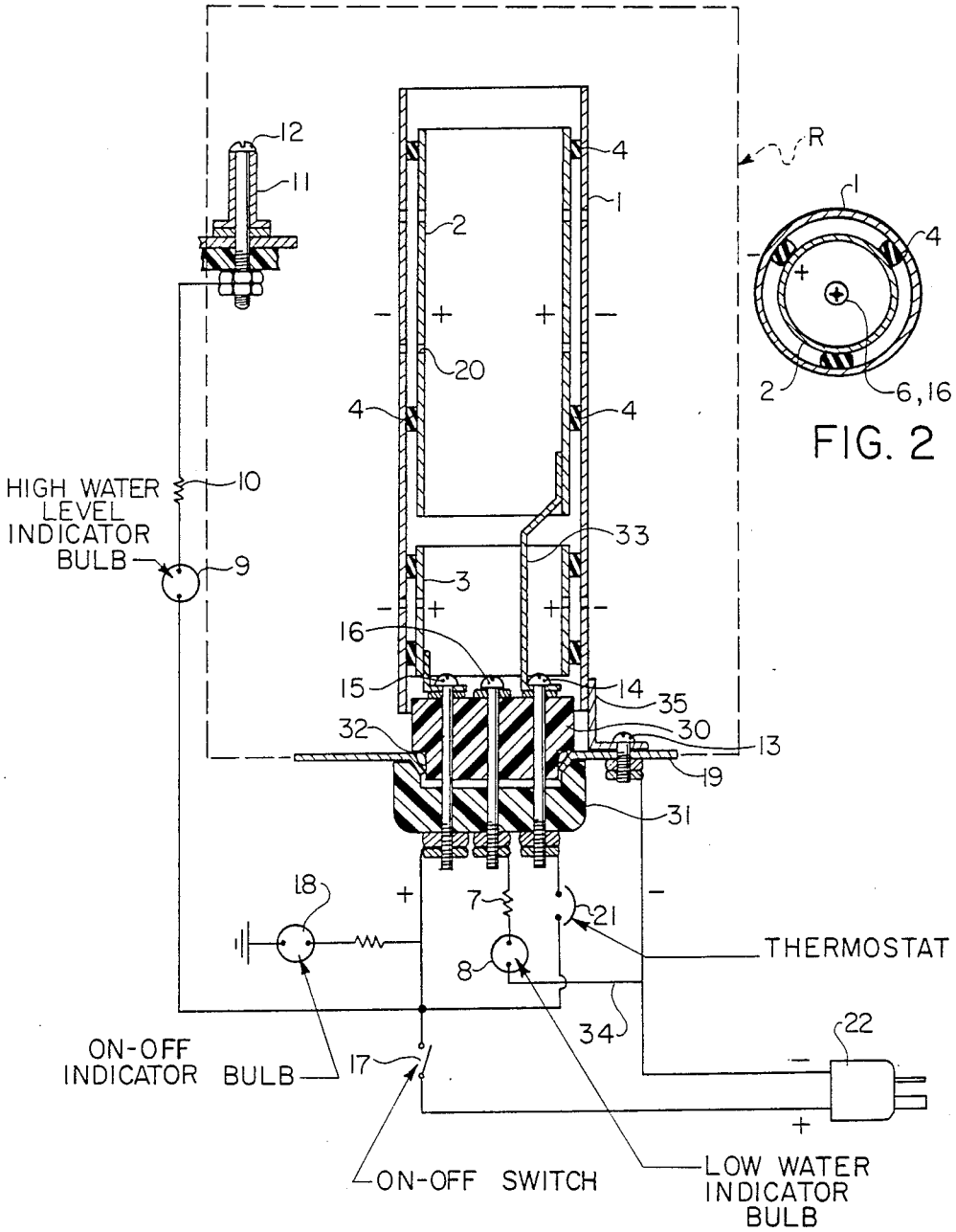
FIG. 1 is a schematic diagram of the preferred embodiment of the present invention, showing a cross section of the preferred embodiment of the heating device, and further showing axially-spaced first and second cylindrical anode members nested within a cylindrical cathode member.
FIG. 2 is a sectional view of the heating device of FIG. 1, showing a plurality of insulating spacers between the cathode and the respective anode members.

With reference to FIG. 1, the water heater device includes a cathode member 1 and an anode member. Preferably, the anode member includes a first anode portion 2 and a second anode portion 3 spaced vertically with respect to each other within the receptacle. Preferably, the anode and cathode members are formed as hollow cylinders or tubes nested relative to each other. The anode portions 2 and 3 are spaced axially of one another, and the cathode member surrounds the anode member. Circumferentially-spaced ceramic insulators 4, shown more clearly in FIG. 2, maintain the spacing between the anode and cathode members and prevent short circuiting therebetween. Perforations or passage means 20, formed in at least the anode portion 2, promote the circulation of water between and around the anode and cathode members.

Figure 4:
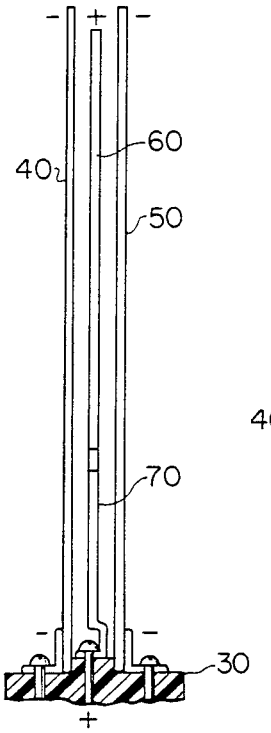
FIG. 4 is a side elevation of the embodiment of FIG. 3, showing the substantially flat cathode members with the spaced anode members received therebetween.
Figure 3:
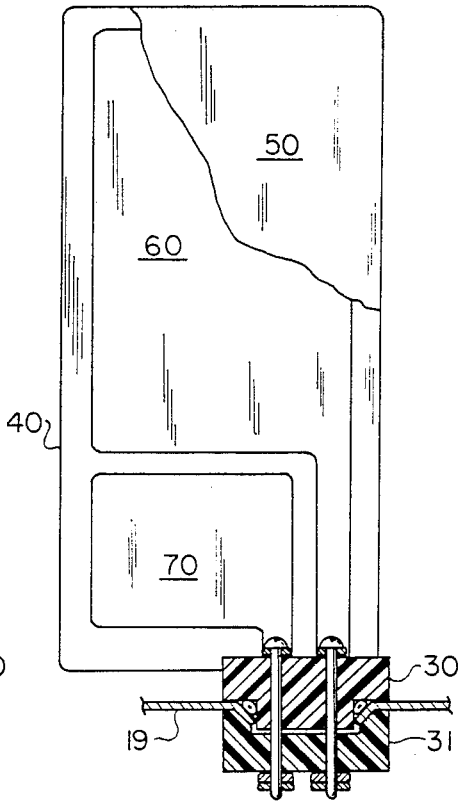
FIG. 3 is a front elevation, partially sectioned, of an alternate embodiment of the present invention, wherein the anode and cathode members are formed as flat plates rather than concentric tubular members.

In the alternate embodiment of FIGS. 3 and 4, the anode and cathode members are substantially flat and have a laminar arrangement. This arrangement includes a first anode member 60, a second anode member 70, and a cathode 48 or cathodes 40 and 50, wherein the anode and cathode members are formed as substantially flat plates, rather than nested right-cylindrical tubes.

With reference again to FIG. 1, a flanged mounting plate 19 is suitably secured within the water tank or other receptacle R (shown diagrammatically by the broken lines in FIG. 1), within which the electric water heater of the present invention is immersed. A first insulated mounting block 30 nested within an opening in the flanged mounting plate 19, and a gasket 32 is disposed therebetween. A second insulated mounting block 31 is secured to the first mounting block by a plurality of conducting fastener means. Preferably, the fastening means comprises three conducting elements or screws 14, 15, and 16, respectively, each of which has a threaded bottom end to receive a suitable nut. The first conducting screw 14 is connected to the first anode portion 2 by means of a strip or bar 33. The second conducting screw 16 is connected to the cathode 1 by means of a resistor 7, indicator bulb 8, line 34, terminal screw 13, and bar 35. The third conducting screw 15 is connected to the second anode portion 3 by means of a bar 36.

The device of the present invention includes a plug 22 for connection to a suitable source of electrical current. A master on/off switch 17 controls the energization of the device. When the switch 17 is in its closed position, a first bulb 18 (or other suitable indicating means) is activated, indicating that power is being supplied to the device.

When the switch 17 is closed, current flows from the plus (+) side of the line, through switch 17, screw 15, second anode portion 3, through the water to cathode 1, and then from the cathode to terminal screw 13 and conductor 34 to the negative (−) side of the line. Simultaneously, a parallel path is established for current flow through a thermally-responsive switch 21, screw 14, bar 33, first anode portion 2, through the water to cathode 1, and again, from the cathode to the terminal screw 13 and conductor 34 to the negative (−) side of the line. The water in the receptacle conducts the current between the respective anode and cathode members, and the current passing through the water heats the water. This is the high (or "hi") mode of operation of the electric water heater of the present invention, and it is intended to rapidly heat the water to a predetermined desired temperature.

When the water has reached the predetermined desired temperature, the thermally-responsive switch 21 opens, thereby disconnecting the parallel path to the first (or "major") anode portion 2. At that time, only the second (or "minor") anode portion 3 is energized. This is the low (or "lo") mode of operation of the electric water heater of the present invention, and it is intended to maintain the water substantially at the predetermined desired temperature.

If the temperature of the water falls below the predetermined desired temperature, thermally-responsive switch 21 will close to again connect the first anode portion 2 into the circuit for again rapidly heating the water and bringing it up to the predetermined desired temperature.

Because the screw 13 is located at the lowest level of the receptacle, it serves as a grounding contact to whatever amount of water is present in the receptacle.

A low water indicating circuit includes the conductive screw 16, a resistive load 7, and a second bulb 8 (or other indicating means). When the water level is sufficient to cover the head of the screw 16, the circuit is completed and the bulb 8 is illuminated to indicate the presence of water in the receptacle.

When the water level is below the head of contact screw 16, the low water indicating circuit is interrupted; and the bulb 8 is turned off, indicating that insufficient water is in the receptacle, and that water must be added to the receptacle.

A high water indicating circuit includes a sensing means such as a conductive screw 12 (or other contact fastener), an insulating means 11, a resistive load 10, and a third bulb 9 (or other indicating means). When the water level reaches the head of the contact screw 12, the high water level indicating circuit is completed; and the third bulb is illuminated, thereby indicating that the desired maximum amount of water is in the receptacle for efficient operation thereof.

With this arrangement, the first bulb 18 indicates that the electric water heater is in operation; the second bulb 8 indicates that water must be added to the receptacle; and the third bulb 9 indicates that sufficient water is in the receptacle, and that no additional water is necessary.

Obviously, many modifications may be made without departing from the basic spirit of the present invention. It will be apparent to those skilled in the art that the anode and cathode members of the present invention may be formed in a variety of shapes and sizes, each adaptable to the receptacle or environment into which it is placed. It will be equally apparent that fluids or substances other than water may be used as the conductive medium, and that a variety of indicating means will accomplish the basic purposes of the invention. Accordingly it will be appreciated by those skilled in the art that within the scope of the appended claims, the invention may be practiced other than has been specifically disclosed herein.

What is claimed is:

1. An electric water heater including a receptacle adapted to receive and contain a quantity of water, electric heating means in said receptacle for heating the water, said heating means comprising an anode member and a cathode member in juxtaposition to the anode member, means for connecting the anode and cathode members to a source of current, at least one of the members having means formed therein for the passage of water therethrough, whereby the current flowing through the water from the anode member to the cathode member heats the water, the anode member having separate first and second portions, said connecting means initially connecting both portions of said anode member and said cathode member to the source of current, thermally-responsive switch means responsive to the temperature of the water in the receptacle for disconnecting one of the portions of the anode member upon attainment of a predetermined water temperature within the receptacle, thereby providing a "hi" and a "lo" heat position, first means associated with said connecting means and said anode and cathode members for indicating that the electric water heater is in operation, and second means disposed in said receptacle for sensing that an insufficiently low water level is in the receptacle, thereby indicating that water must be added to the receptacle.

2. The electric water heater of claim 1, further including third means in said receptacle for indicating that a sufficiently high level of water is in the receptacle.

3. The electric water heater of claim 1, wherein the anode and cathode members are formed as hollow cylindrical tubes nested concentrically within one another.

4. The electric water heater of claim 3, wherein the cathode member surrounds the anode member, and wherein circumferentially-spaced insulation means is provided between the anode and cathode members.

5. The electric water heater of claim 1, wherein the first and second portions of the anode member are spaced vertically with respect to one another with said receptacle.

6. The electric water heater of claim 1, wherein an insulating block means is mounted within said receptacle for supporting the anode and cathode members, and wherein said connecting means comprises respective spaced conductor means carried by the insulating block means for connecting the anode member to a source of current.

7. The electric water heater of claim 6, wherein the insulating block means comprises first and second insulating blocks, and further including a mounting flange secured between the first and second insulating blocks, at least one gasket between the mounting flange and one of the insulating blocks, thereby providing a sealing juncture between the mounting flange and the insulating blocks, and said receptacle including a receptacle wall having an opening for receiving the mounting flange, the mounting flange being secured to the receptacle wall.

8. The electric water heater of claim 7, wherein the respective conductor means includes first, second and third conductive screws carried by the blocks, wherein means are provided for electrically connecting the first screw between the first anode portion and the positive side of the current source, wherein the cathode is connected to the negative side of the current source, wherein the second conductive screw is connected to the junction of the cathode and the negative side of the current source, and wherein the third conductive screw is connected between the second anode portion and the positive side of the current source in a path parallel to the first anode portion.

9. The electric water heater of claim 8, wherein the means for electrically connecting the first screw between the first anode portion and the positive side of the current source includes said thermally-responsive switch means.

10. The electric water heater of claim 8, wherein the first means for indicating that the electric water heater is in operation includes a first indicator bulb connected between the third conductive screw and ground.

11. The electric water heater of claim 8, wherein the second means for indicating that water must be added to the receptacle includes a second indicator bulb connected between the second conductive screw and the negative side of the current source.

12. The electric water heater of claim 8, wherein the third means for indicating that the receptacle is full includes a third indicating bulb connected between the positive side of the current source and a sensing means located at the high water level mark inside of the receptacle.

13. The electric water heater of claim 12, wherein the sensing means includes a contact screw, the head of which senses the water level in the receptacle.

14. An electric water heater including a receptacle adapted to receive and contain a quantity of water, electric heating means within said receptacle, said heating means being energized from a source of current and comprising an anode member having first and second hollow cylindrical anode portions spaced vertically relative to one another within said receptacle, a hollow cylindrical cathode member concentrically surrounding the respective portions of the anode member, means for electrically connecting said cathode member to the negative side of the current source, circumferentially-spaced insulation means provided between the anode and cathode members, insulating block means mounted within the receptacle for supporting the anode and cathode members thereabove, a plurality of conductive spaced screws including first, second and third screws carried by the insulating block means, wherein the first conductive screw is electrically connected between the first anode portion and the positive side of the current source, wherein the third conductive screw is electrically connected between the second anode portion and the positive side of the current source in a path parallel to the first anode portion, and wherein the second conductive screw is electrically connected to the junction of the cathode and the current source, a thermally-responsive switch in the electrical connection between the first conductive screw and the positive side of the current source, said thermally-responsive switch being responsive to the temperature of the water in the receptacle, wherein said thermally-responsive switch is closed when the water in the receptacle is below a predetermined temperature, and wherein said thermally-responsive switch is open when the water in the receptacle is above a predetermined temperature, a first indicating means connected between the third conductive screw and ground for indicating that the electric water heater is in operation, a second indicating means in the electrical connection between the second conductive screw and the negative side of the current source for indicating that water must be added to the receptacle, and a third indicating means connected between a sensing means located at the high water level mark of said receptacle and the positive side of the current source to indicate that the receptacle is full.

* * * * *